United States Patent [19]

Lessard et al.

[11] Patent Number: 4,584,069

[45] Date of Patent: Apr. 22, 1986

[54] ELECTRODE FOR CATALYTIC ELECTROHYDROGENATION OF ORGANIC COMPOUNDS

[75] Inventors: Jean Lessard; Gérard Belot, both of Sherbrooke, Canada

[73] Assignee: Universite de Sherbrooke, Quebec, Canada

[21] Appl. No.: 704,461

[22] Filed: Feb. 22, 1985

[51] Int. Cl.[4] ..... C25B 3/00

[52] U.S. Cl. ..... 204/74; 204/290 R

[58] Field of Search ..... 204/290 R, 74

[56] References Cited

U.S. PATENT DOCUMENTS 3,272,728 9/1966 Hahndorff ..... 204/290 R

*Primary Examiner*—John F. Niebling

*Attorney, Agent, or Firm*—Cushman, Darby & Cushman

[57] ABSTRACT

There is provided an electrode adapted for the selective electrocatalytic hydrogenation of nitro groups to amino groups comprising a thin grid coated with a thin layer of nickel, the latter being itself coated with a further layer of nickel in which are dispersed or embedded fine particles of Devarda copper or Raney copper.

11 Claims, No Drawings

ELECTRODE FOR CATALYTIC ELECTROHYDROGENATION OF ORGANIC COMPOUNDS

The present invention relates to a novel electrode which is particularly suitable for the conversion of organic nitro compounds to the corresponding amino compounds by electrocatalytic hydrogenation.

BACKGROUND OF THE INVENTION

At the present time, there are three known methods for reducing nitro groups to amine groups.

The first method is generally referred to as the chemical reduction and involves carrying out the reduction of the nitro groups to amine groups by treatment of the aromatic nitro compounds with metals such as zinc, tin or iron in the presence of an acid such as hydrochloric acid. On the other hand, when the reduction is carried out with zinc in a neutral or basic aqueous medium, the aromatic nitro compound is reduced to hydroxylamines or azo compounds respectively. It is also known that lithium aluminum hydride reduces aromatic nitro compounds to amines whereas borane is known to reduce aliphatic nitro compounds to hydroxylamines.

Another form of reduction is that carried out by catalytic hydrogenation whereby aromatic and aliphatic nitro compounds are reduced to amines with hydrogen in the presence of Raney nickel, platinum or palladium usually in finely divided form. Raney nickel is usually formed 'in situ' while platinum and palladium are used as the oxides which are reduced in the course of the hydrogenation to the elementary metals, or as metals supported on charcoal, calcium carbonate or other inert carrier.

Finally, there is an extensive literature on electrochemical reduction of aromatic nitro compounds to amines, p-aminophenols, azoxy compounds, azo compounds, hydrazo compounds and benzidines in aqueous or aqueous-alcoholic solutions, the course of the reaction depending upon the pH of the solution. It is also known to reduce aliphatic nitro compounds to hydroxylamines in an acidic medium.

Notwithstanding the respective advantages of each of the above-described reduction methods, none of them displays simultaneously the advantages of high selectivity, low cost, safeness, absence of pollution and toxicity.

Accordingly, it would appear to be highly desirable if a hydrogenation electrode could selectively hydrogenate nitro compounds to the corresponding amines even in the presence of other functional groups while providing highly desirable yields and current efficiencies.

SUMMARY OF THE INVENTION

In accordance with the present invention, there is now provided a novel electrode particularly adapted for the selective electrocatalytic hydrogenation of nitro groups to amino groups.

Essentially, the novel electrode of the present invention comprises a thin steel grid coated with a thin layer of nickel, the thin layer of nickel being itself coated with a further layer of nickel in which are dispersed or embedded fine particles of a Devarda copper alloy or a Raney copper alloy.

It has surprisingly been found that the novel electrode coated with Devarda copper or Raney copper offers very high selectivity for the reduction of nitro groups to amino groups even in the presence of other functional groups. It has also been found that the amines obtained according to the process of the present invention can be easily recovered since the reduction step is carried out in a basic medium. A further advantage of the novel electrode of the present invention is that the reduction step is easily controlled, it proceeds smoothly and avoids the use of noxious and polluting reagents while providing chemical yields and current efficiencies which are higher than 90%. Finally, it has been noted that because of the low overvoltage of the electrode, the energy consumption is much lower than when using other electrodes.

DETAILED DESCRIPTION

More specifically, the electrode of the present invention comprises:

(a) a thin grid coated with a layer of from 2 to 10μ of nickel deposited thereon;

(b) a second nickel layer deposited over said first layer, said second layer having embedded therein particles of copper-zinc-aluminum or of copper-aluminum alloy having a particle size of from 45 to 10μ, the thickness of said second layer being from 50 to 250μ.

The thin grid support is essentially a wire metal grid or a wire net type sheet having 60 to 3 mesh and where the diameter of the wire varies from about 0.15 to 2 mm. The grid can be made from iron, iron alloy, stainless steel, copper, nickel, nickel alloy such as NICHROM®, INCONEL®, MONEL® and similar nickel alloys. Stainless steel has been found most adequate for the purpose of the present invention.

The thin grid support is subjected to a first coating by depositing a thin layer of nickel having a thickness of from 2 to 10μ. This first coating step is carried out by first degreasing the thin grid support in an alkaline aqueous bath at about 80° C., for a period of about 30 minutes. Any other equivalent method of degreasing a metal before electroplating may also be used.

The degreased thin grid is then plated in a nickel electroplating bath by using it as a cathode and a nickel plate as an anode. The nickel bath is maintained at a temperature of about 25° C., at a current density of 0.8 $A/dm^2$. The nickel bath is made up of an aqueous solution of a mixture of nickel salts such as nickel sulfate and nickel chloride in the presence of an acid such as boric acid. The electroplating is carried out for a period of time sufficient to deposit a layer of nickel of from 2 to 10μ. For example, a layer of 2.5μ will be deposited in about 15 minutes.

Before proceeding to deposit a second layer of nickel over the first layer, there is added Devarda copper alloy powder (Cu: 50%, Al: 45% and Zn: 5%) (325 mesh pass) to the first nickel plating bath at a concentration of from 5 to 20 g/l, a concentration of about 10 g/l being preferred. Here again, the nickel plated grid is used as a cathode and a nickel plate as an anode while the temperature of the bath is maintained at about 25° C. with a current density of 1.3 $A/dm^2$ for a period of about one hour. Devarda copper particles are found to be deposited on the surface of the second layer of nickel in an amount of from 1 to 2 $g/dm^2$. Similar results can be obtained with a Raney copper alloy (Cu: 50%, Al: 50%).

The electrode is then activated by treatment with an alkali hydroxide solution such as a 20% wt sodium hydroxide which removes the aluminum and zinc when a Devarda copper alloy is used and the aluminum when a Raney copper alloy is used. The particle size of the embedded Devarda copper or Raney copper varies from 45 to 10μ.

The nickel plating bath used herein is one of any nickel plating baths used in the nickel plating industry. For example, a bath made up of a mixture of nickel sulfate also known as blue salt ($NiSO_4.6H_2O$), nickel chloride and boric acid may be used.

Once the electrode of the present invention has been prepared it must be activated in order to confer it electrocatalytic properties. This is done by soaking the electrode in a 20% wt aqueous sodium hydroxide solution at 70° C. for 8 hours. Subsequently, it is thoroughly rinsed with deionized water and stored in methanol.

The main advantage of the electrode of the present invention is that it specifically hydrogenates nitro compounds to the corresponding amines. In practice the electrode of the present invention is placed in a cell containing previously deaerated ($N_2$) electrolysis medium and its potential is lowered (−1.2 v/SCE) in order to generate hydrogen at the surface of the electrode for at least 20 minutes bringing the electrode active surface to saturation. Then the potential is slowly varied in order to get the zero current point (−0.96 v/SCE) and the nitro product to be hydrogenated is added in one portion whereby this addition causes the reduction while hydrogenation proceeds. The end of the electrolysis is noted by a significant drop of the current in which case the nitro compound is almost completely consumed. The catholyte is then neutralized, extracted with a solvent and dried.

The present invention will be more readily understood by referring to the following examples which illustrate the invention.

EXAMPLE I

Preparation of the Electrode

A stainless steel wire gauze having 60 mesh and a wire diameter of 0.25 mm and a size of 4×3 cm was first degreased in an alkaline aqueous bath (KOH : 30 g/l; $K_3PO_4$ : 30 g/l; $K_2SiO_3$:10 g/l) at 80° C. for 30 minutes and then treated by the following plating process into a bath of nickel ($NiSO_4.6H_2O$: 300 g/l; $NiCl_2.6H_2O$: 45 g/l; $H_3BO_3$: 30 g/l) by using said stainless steel wire gauze as a cathode and a nickel plate as an anode at 25° C. at a current density of 0.8 A/dm$^2$. A 2.5μ thick layer of nickel is thus formed in 15 minutes on the said wire gauze.

A further treatment of the plated wire gauze is carried out in a Devarda copper alloy dispersion; into a bath of nickel ($NiSO_4.6H_2O$: 300 g/l; $NiCl_2.6H_2O$: 45 g/l; $H_3BO_3$ : 30 g/l) Devarda copper alloy powder (Cu: 50% wt; Al: 45% wt; Zn: 5% wt) (325 mesh pass) was added at a concentration of 10 g/l and the dispersion was stirred.

A plating was carried out by using said wire gauze as a cathode and a nickel plate as an anode at 25° C. at a current density of 1.3 A/dm$^2$ for 1 hour.

On the surface of the wire gauze, Devarda copper alloy particles were deposited in an amount ranging from 1 to 2 g/dm$^2$ together with nickel in a layer having a thickness of from 50 to 250μ.

Activation of the Electrode

In order to confer the electrode its electrocatalytic properties, it was treated by a 20% wt NaOH aqueous solution at 70° C. for 8 hours. The electrode was then thoroughly rinsed with deionized water and stored in methanol. The sodium hydroxide treatment removes the aluminum and zinc from the Devarda copper alloy or the aluminum when a Raney copper alloy is used. The finished electrode had a nickel plated surface in which Devarda copper was embedded in the form of particles having from 45 to 10μ in size.

EXAMPLE II

The activated Devarda copper electrode from Example I was placed in the cathodic compartment of a divided electrochemical cell.

The supporting electrolyte was a methanolic solution of KOH (0.27 M) with 1.5% $H_2O$, deaerated with nitrogen.

The anode was a platinum grid.

The electrocatalytic hydrogenation of nitrobenzene was performed at a cathode potential of −0.900 v vs SCE; aniline was obtained in 92% yield and the current efficiency was 90%.

EXAMPLE III

The experimental conditions being the same as in Example II, nitrocyclohexane was electrocatalytically hydrogenated to cyclohexylamine in 100% yield, the current efficiency was 99%.

EXAMPLE IV

The experimental conditions being the same as in Example II, p-nitro acetophenone was electrocatalytically hydrogenated to p-amino acetophenone in 90% yield, the current efficiency was 95%.

We claim:

1. An electrode adapted after activation for the selective electrocatalytic hydrogenation of nitro groups of organic compounds to amino groups comprising a thin grid of metallic material coated with a thin layer of nickel, the latter being itself coated with a further layer of nickel in which are dispersed or embedded fine particles of Devarda copper alloy or Raney copper alloy.

2. An electrode adapted after activation for the selective electrocatalytic hydrogenation of nitro groups of organic compounds to amino groups comprising a thin grid of metallic material coated with a layer of from 2 to 10μ of nickel, said layer of nickel being itself coated with a layer of from 50 to 250μ of nickel in which are embedded Devarda copper alloy or Raney copper alloy particles of from 45 to 10μ.

3. The electrode of claim 2, wherein the grid is a wire net type having 60 to 3 mesh and the diameter of the wire is from 0.15 to 2 mm.

4. The electrode according to claim 2 wherein the grid is a steel grid.

5. The electrode according to claim 1 wherein the grid is a steel grid.

6. A bath for reducing a nitro group in an organic compound to an amine group, said bath containing the electrode of claim 1 after activation and a nitro group containing organic compound.

7. A bath for reducing a nitro group in an organic compound to an amine group, said bath containing the electrode of claim 2 after activation and a nitro group containing organic compound.

8. A process of electrolytically reducing a nitro group in an organic copound to an amine group comprising hydrogenating the nitro group containing organic compound in a bath containing the nitro group containing organic compound and the electrode of claim 1 after activation.

9. A process of electrolytically reducing a nitro group in an organic compound to an amine group comprising hydrogenating the nitro group containing organic compound in a bath containing the nitro group containing organic compound and the electrode of claim 2 after activation.

10. The electrode obtained by activating the electrode of claim 1.

11. The electrode obtained by activating the electrode of claim 2.

* * * * *